US007222996B2

(12) United States Patent
Lin

(10) Patent No.: US 7,222,996 B2
(45) Date of Patent: May 29, 2007

(54) SHELF LAMP

(76) Inventor: Jack Lin, 6F, No. 51, Lushin Street, Luchu Hsiang, Taoyuan Hsien (TW)

( * ) Notice: Subject to any disclaimer, the term of this patent is extended or adjusted under 35 U.S.C. 154(b) by 14 days.

(21) Appl. No.: 11/022,671

(22) Filed: Dec. 28, 2004

(65) Prior Publication Data

US 2006/0139936 A1 Jun. 29, 2006

(51) Int. Cl.
*F21V 21/088* (2006.01)

(52) U.S. Cl. ..... 362/396; 362/132

(58) Field of Classification Search ..... 362/396, 362/399, 400, 457, 647, 657, 655, 556, 132
See application file for complete search history.

(56) References Cited

U.S. PATENT DOCUMENTS 2,247,022 A * 6/1941 Hovorka ..... 362/396
5,448,463 A * 9/1995 Leen ..... 362/396
5,510,970 A * 4/1996 Hollenbach et al. ..... 362/396

* cited by examiner

*Primary Examiner*—Laura K. Tso

(57) ABSTRACT

A shelf lamp includes a clamp mount, which includes two clamp arms being pivotally connected by incorporating with an elastic element, and an illuminating unit. Each of the clamp arms includes at least a connection portion for providing the illuminating unit to connect thereon. The illuminating unit includes a harness element extended from one end thereof for harnessing onto the connection portion. The harness element is of a shape corresponding to the shape of the connection portion. The illuminating direction can thus be changed by changing the connection portion that the illuminating unit is harness on.

6 Claims, 8 Drawing Sheets

SHELF LAMP

BACKGROUND OF THE INVENTION

The present invention relates generally to a shelf lamp, and more particularly to a shelf lamp that can change the illuminating direction and position according to the customized assembly of the clamp mount and the illuminating unit thereof, thereby achieving a better mobility and accessibility of the illuminating directions. In addition, the assembly and operation of the shelf lamp of the present invention do not require any tool accompanying the shelf lamp of the present invention, the storage space and the manufacturing cost of which is thus reduced.

Conventional shelf lamps, especially bookshelf lamps, are installed and securely fastened to predetermined positions on the shelf. Referring to FIG. 8, a conventional shelf lamp 1 is illustrated. The shelf lamp 1 includes a lamp cover 11, a lamp rod 12, and a clamp 13. The clamp 13 includes an upper clamp piece 131 and a lower clamp piece 132, which are pivotally connected via an ear piece incorporating with an elastic element (not shown). A pipe pillar is disposed on the upper clamp piece 131 for connecting the lamp rod 12 therewith. The lamp rod 12 is a snake neck pipe, which connects with the lamp cover 11 at the other end thereof. In this manner, the shelf lamp 1 can be securely fastened onto a holding position, such as the shelf wall or a desk side, by using the clamp 13, and changing the illuminating direction and angle by employing the lamp rod 12. However, the illuminating unit and the lamp cover 11 of the conventional shelf lamp 1 described above are disposed above the clamp 13, the illuminating directions are mostly limited to around the neighborhood of the holding position where the clamp 13 is fastened onto. Although the illuminating angles can be adjusted by using the lamp rod 12, the adjustable angles and directions are largely restricted. Furthermore, the conventional shelf lamp 1 can not illuminate the dead corners of the bookshelf and/or the bottom of the desk. Even worse, the conventional shelf lamp 1 is assembled into one entity, while the turning angle of the lamp rod 12 is strictly limited, the overall storage volume of the conventional shelf lamp can not be reduced further during transportation. Therefore, there is no way to bring down the cost for transportation and storage.

Although various other shelf lamps are disclosed in the published Taiwanese New Utility Model Patent No. 563788, 500210, 497687, 356913, 200930, 121433 and 103883, all the shelf lamps are provided without deviating from the conventional single entity shelf lamp structure that include a lamp cover 11, a lamp rod 12 and a clamp 13. Only the joint or the bottom mount are improved, which can not solve the problem of limited illuminating directions, angles and positions. Moreover, the problem in the reduction of cost for transportation and storage is also untouched.

BRIEF SUMMARY OF THE INVENTION

The present invention is to provide a shelf lamp that the clamp mount and the illuminating unit are detachable from each other.

The present invention is also to provide a shelf lamp that can customize the assembly of the clamp mount and the illuminating unit, thereby achieving a better mobility and accessibility of the illuminating directions.

The present invention is still to provide a shelf lamp that can reduce the storage space and the manufacturing cost.

In order to achieve the above and other objectives, the shelf lamp of the present invention includes a clamp mount, which includes two clamp arms being pivotally connected by incorporating with an elastic element, and an illuminating unit. Each of the clamp arms includes at least a connection portion for providing the illuminating unit to connect thereon. The illuminating unit includes a harness element extended from one end thereof for harnessing onto the connection portion. The harness element is of a shape corresponding to the shape of the connection portion. The illuminating direction can thus be changed by changing the connection portion that the illuminating unit is harness on. Since the shelf lamp of the present invention is detachable, the package size is reduced, thereby lowering the cost of storage and transportation.

DETAILED DESCRIPTION OF THE INVENTION

In order to better understanding the features and technical contents of the present invention, the present invention is hereinafter described in detail by incorporating with the accompanying drawings. However, the accompanying drawings are only for the convenience of illustration and description, no limitation is intended thereto.

Figure 1:
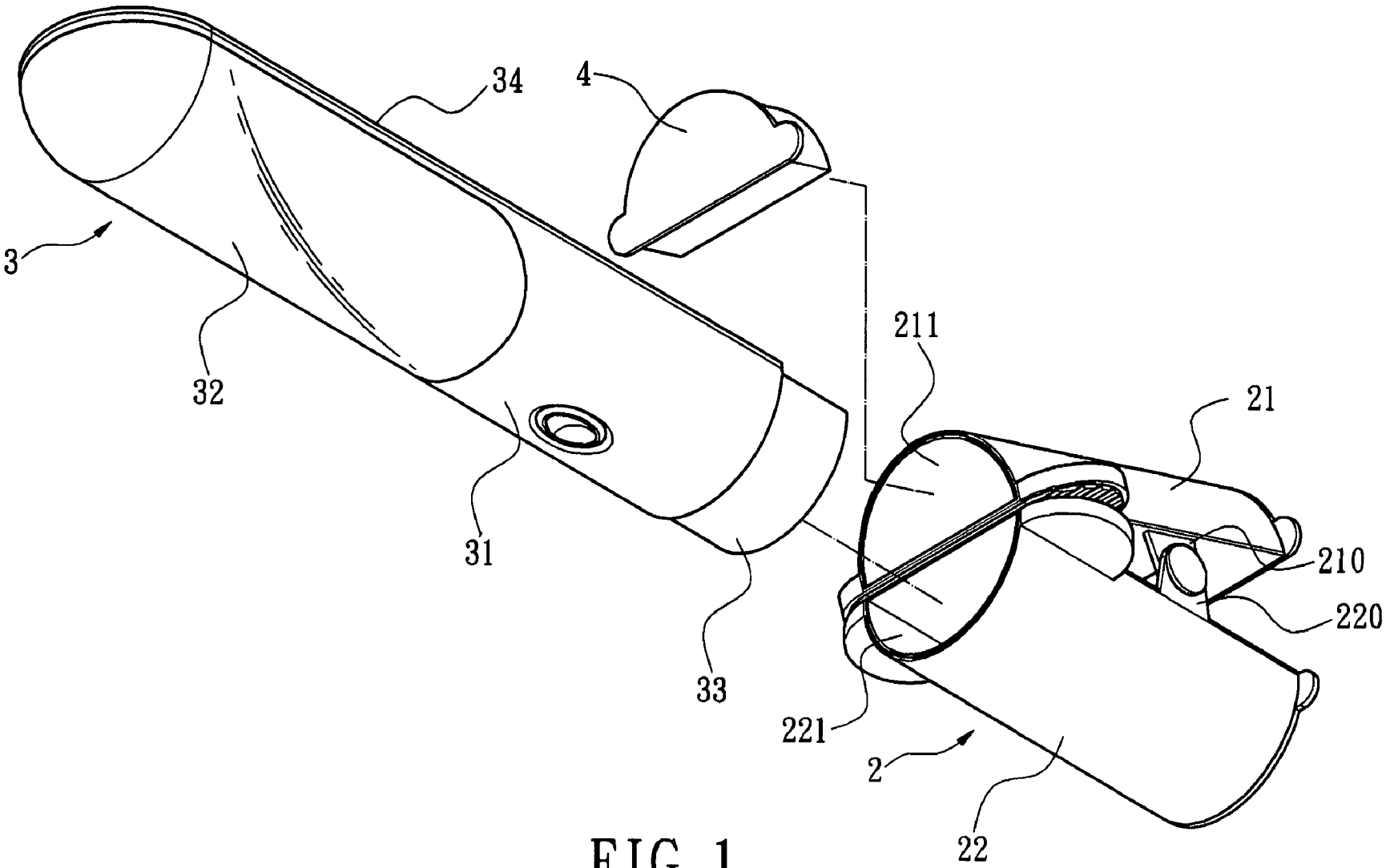
FIG. 1 is an explosive view of a shelf lamp, in accordance with one embodiment of the present invention.
Figure 2:
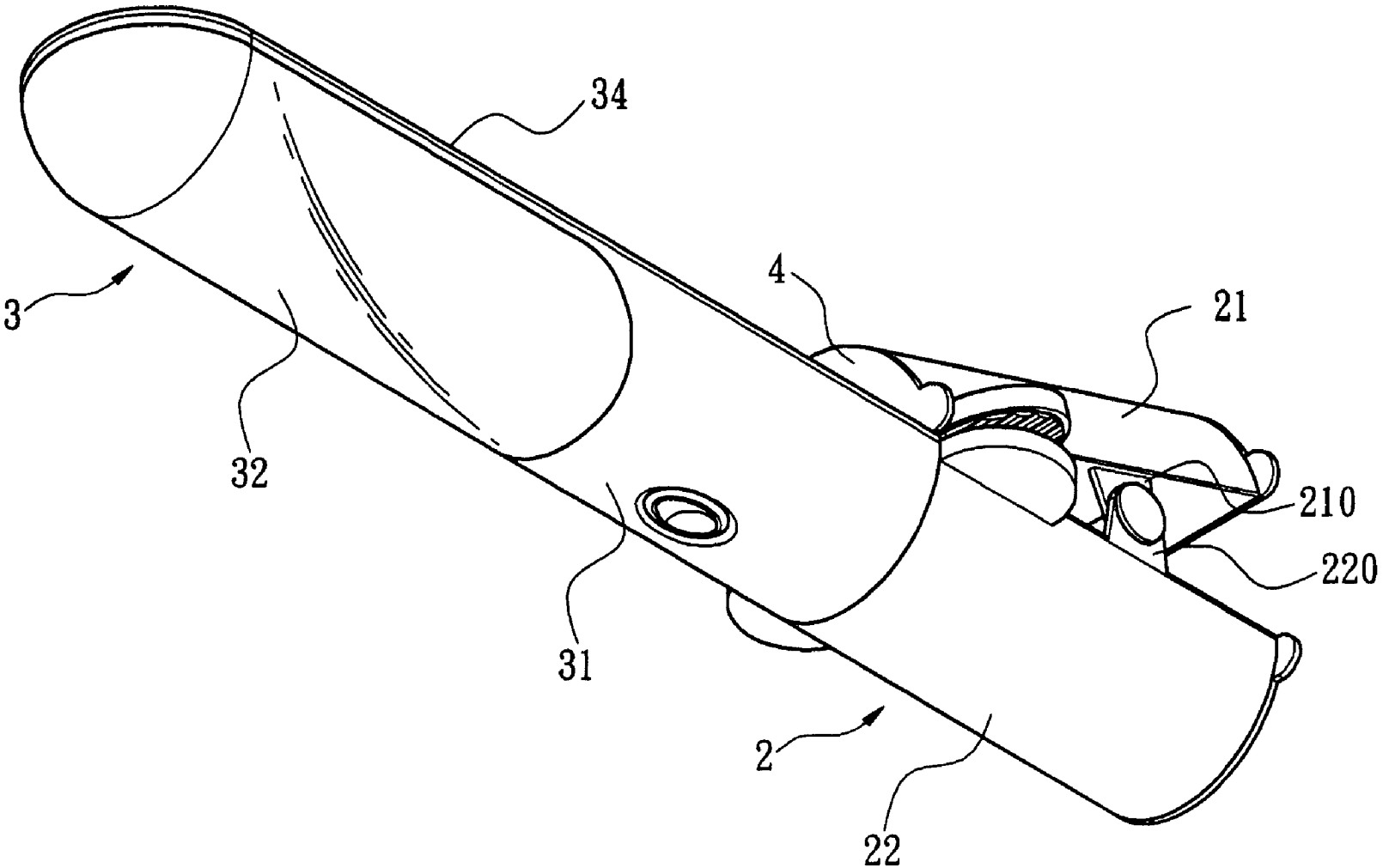
FIG. 2 is a perspective view of the shelf lamp, in accordance with one embodiment of the present invention.

Referring to FIG. 1 to FIG. 4, a preferred embodiment of a shelf lamp of the present invention is illustrated. The shelf lamp includes a clamp mount 2, a illuminating unit 3 harnessed on the clamp mount 2, and a plurality of covers 4 for sealing the connection ends of the clamp mount 2 (as shown in FIG. 1 and FIG. 2).

Figure 3:
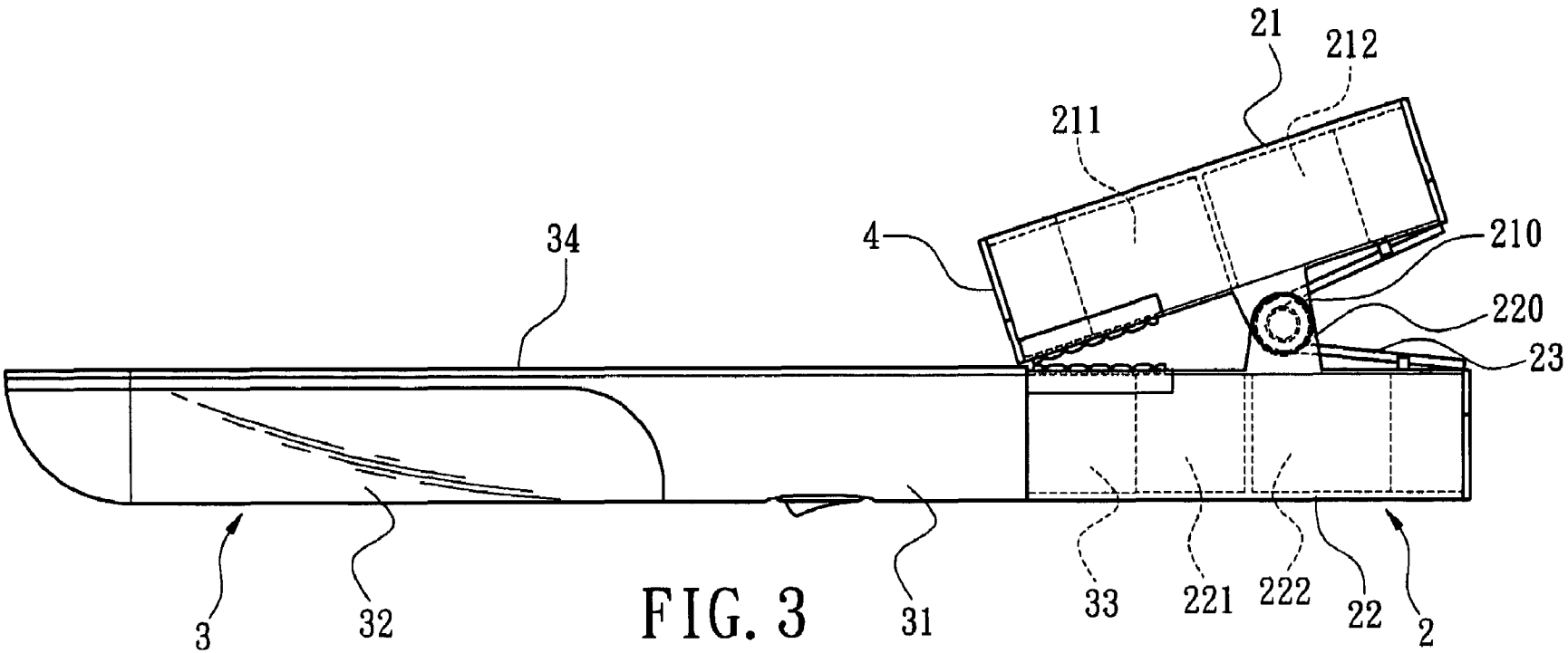
FIG. 3 is a sectional view of the shelf lamp, in accordance with one embodiment of the present invention.
Figure 4:
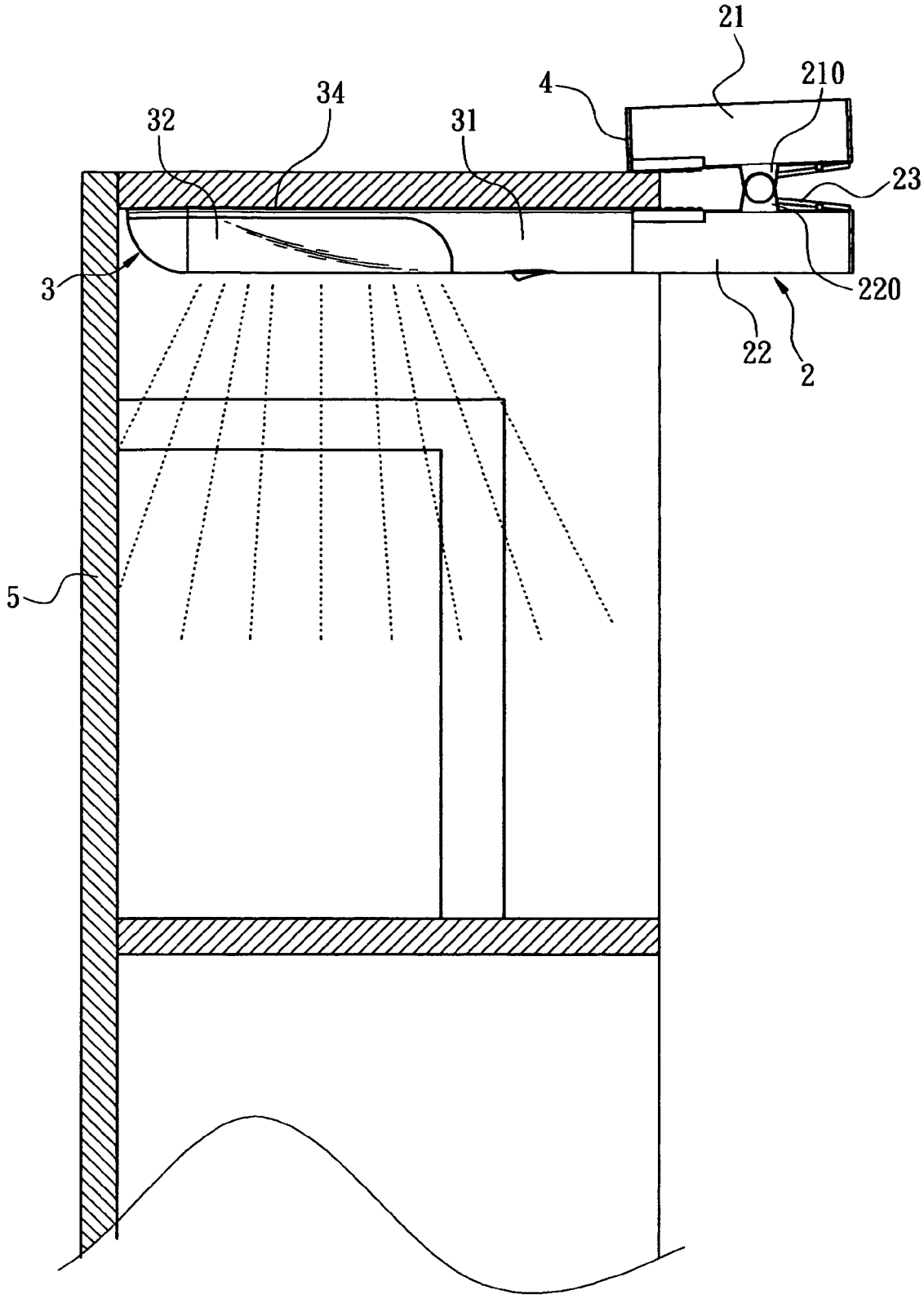
FIG. 4 is a sectional view illustrating the shelf lamp in combination with a shelf, in accordance with one embodiment of the present invention.

The clamp mount 2 includes a first clamp arm 21 and a second clamp arm 22. The first clamp arm 21 and the second clamp arm 22 are pivotally connected with each other by using the protrusively formed pivotal ears 210, 220. An elastic element 23, preferably a torque spring, is disposed between the two clamp arms 21, 22, thereby providing a clamping force for securely fasten the shelf lamp of the present invention onto a holding unit 5 (e.g. a shelf wall, a desk or a working platform, as shown in FIG. 4). Referring to FIG. 3, concave connection portions 211, 212, 221, 222 are formed on the two ends of both the first and the second clamp arms 21, 22, respectively. The illuminating unit 3 is then disposed on one of the connection portions 211, 212, 221, 222 as desired, allowing the illuminating unit 3 to point to different directions.

The first and the second clamp arms 21, 22 are hollow inside. In addition, the connection portions 211, 212, 221, 222 are formed of the same shape. Therefore, the illuminating unit 3 can choose any one of the connection portions 211, 212, 221, 222 to dispose thereon, thus allowing the illuminating unit 3 to point to different directions.

Since one of the connection portions 211, 212, 221, 222 of the first and the second clamp arms 21, 22 is connected with the illuminating unit 3, the unused connection portions 211, 212, 221 or 222 are covered with the cover 4, as shown in FIG. 2 and FIG. 3. In this manner, the connection portions 211, 212, 221, 222 are protected from dusts or foreign objects, while the aesthetic purposes are considered as well.

The illuminating unit 3 (shown in FIG. 1) includes a lamp shell 31, which is hollow inside, providing a light emitting element to be electrically connected therein (not shown). The light generated from the light emitting element is projected out through the transparent cover 32 of the lamp shell 21. One end of the lamp shell 31 includes a harness element 33 of a shape corresponding to the shape of the connection portions 211, 212, 221, 222 of the clamp mount 2. The harness element 31 can thus be harnessed directly onto one of the connection portions 211, 212, 221, 222, thereby combining the illuminating unit 3 and the clamp mount 2. In addition, the lamp shell 31 includes a flat surface 34, which is aligned with the surface of the holding unit 5 when clamping the shelf lamp onto the holding unit 5.

According to the descriptions set forth above, the illuminating unit 3 is harness on any one of the connection portions 211, 212, 221, 222 of the clamp mount 2. The clamp mount 2 is then clamped on the holding unit 5, thereby providing light inside a bookshelf. As shown in FIG. 2 to FIG. 4, the harness element 33 of the illuminating unit 3 is inserted into the connection portion 221. When the clamp mount 2 is fastened on the holding unit 5 (bookshelf, desk, or working platform), the illuminating unit 3 is extended to the internal portion of the holding unit 5. The flat surface 34 faces the flat surface of the holding unit 5, thereby providing light inside of the holding unit 5, as shown in FIG. 4.

Figure 5:
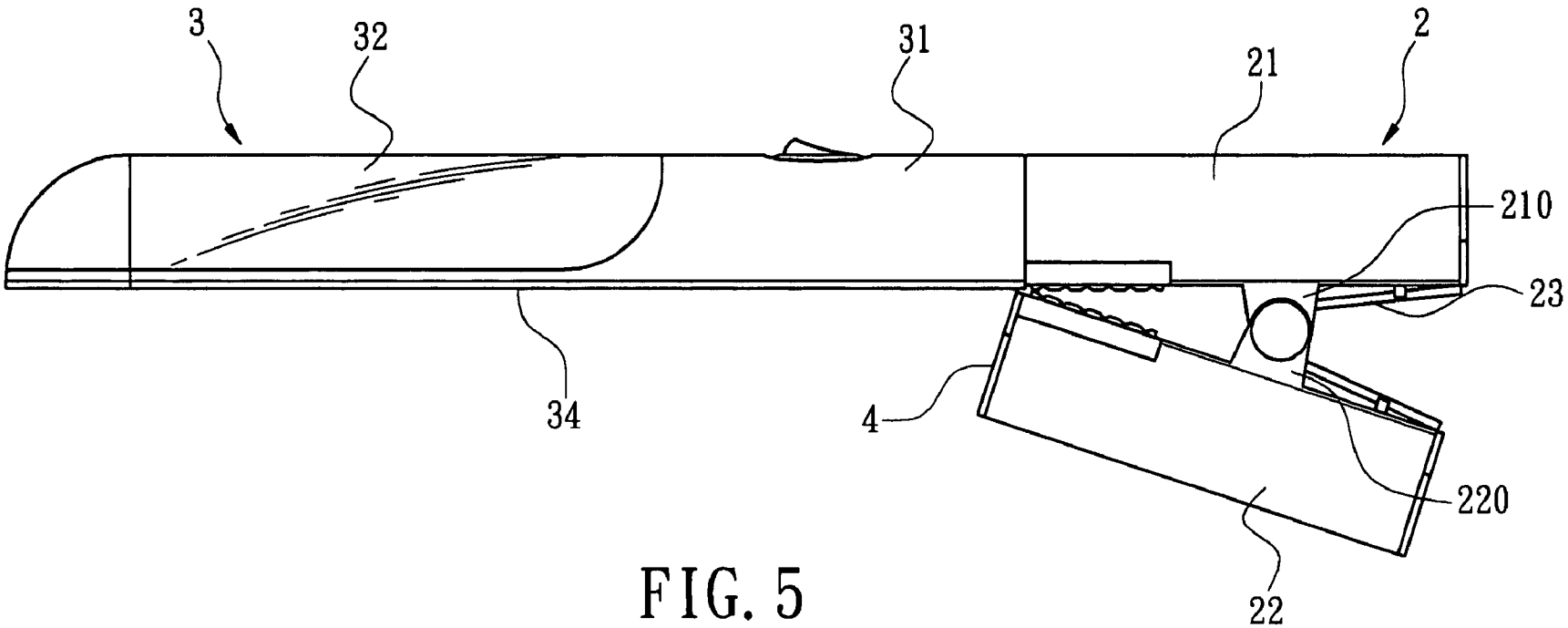
FIG. 5 is a sectional view of the shelf lamp, in accordance with another embodiment of the present invention.
Figure 6:
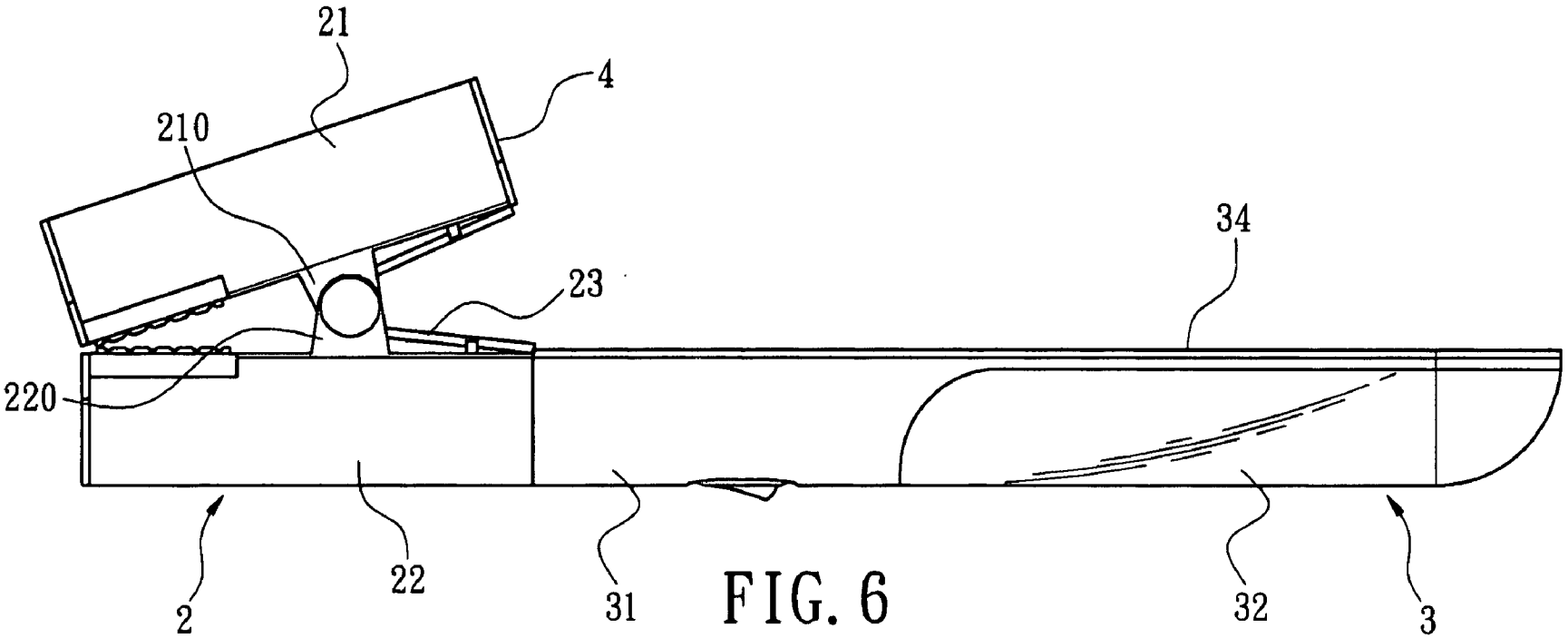
FIG. 6 is a sectional view of the shelf lamp, in accordance with yet another embodiment of the present invention.
Figure 7:
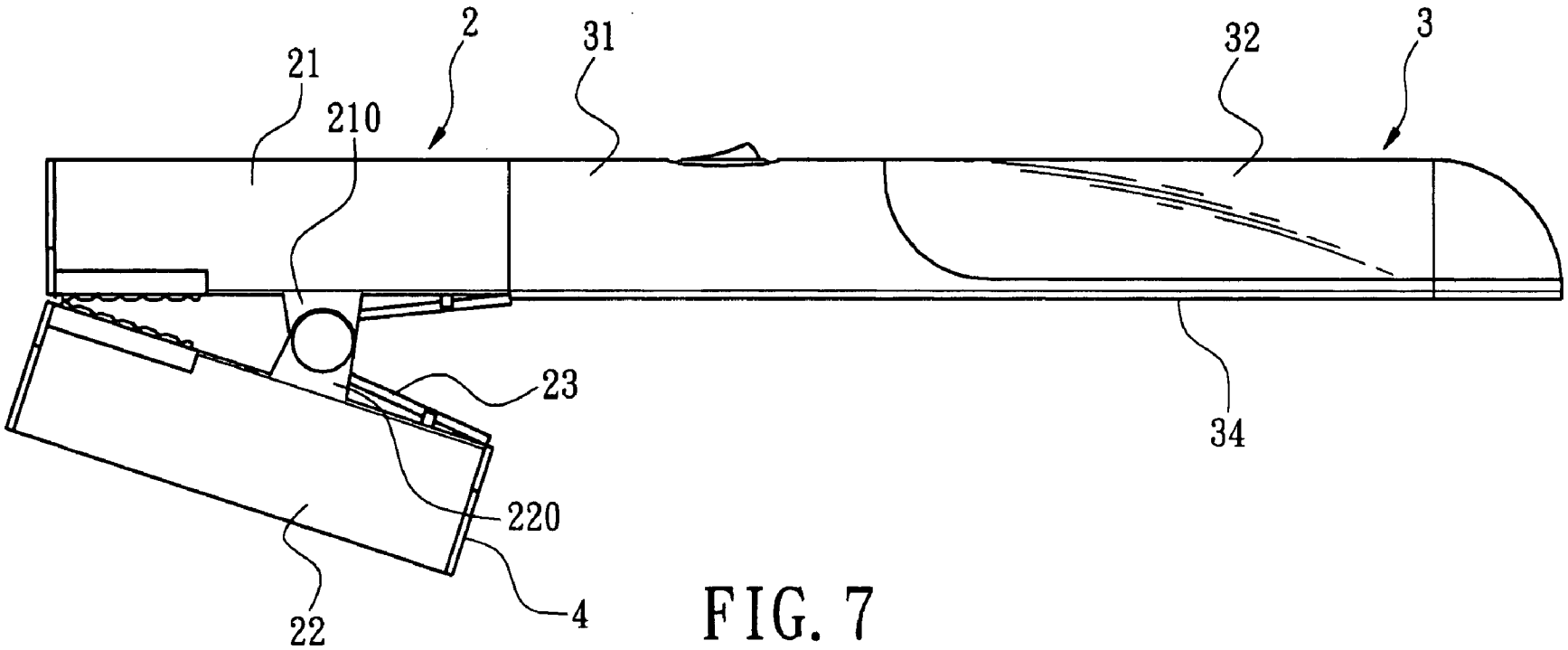
FIG. 7 is a sectional view of the shelf lamp, in accordance with still another embodiment of the present invention.
Figure 8:
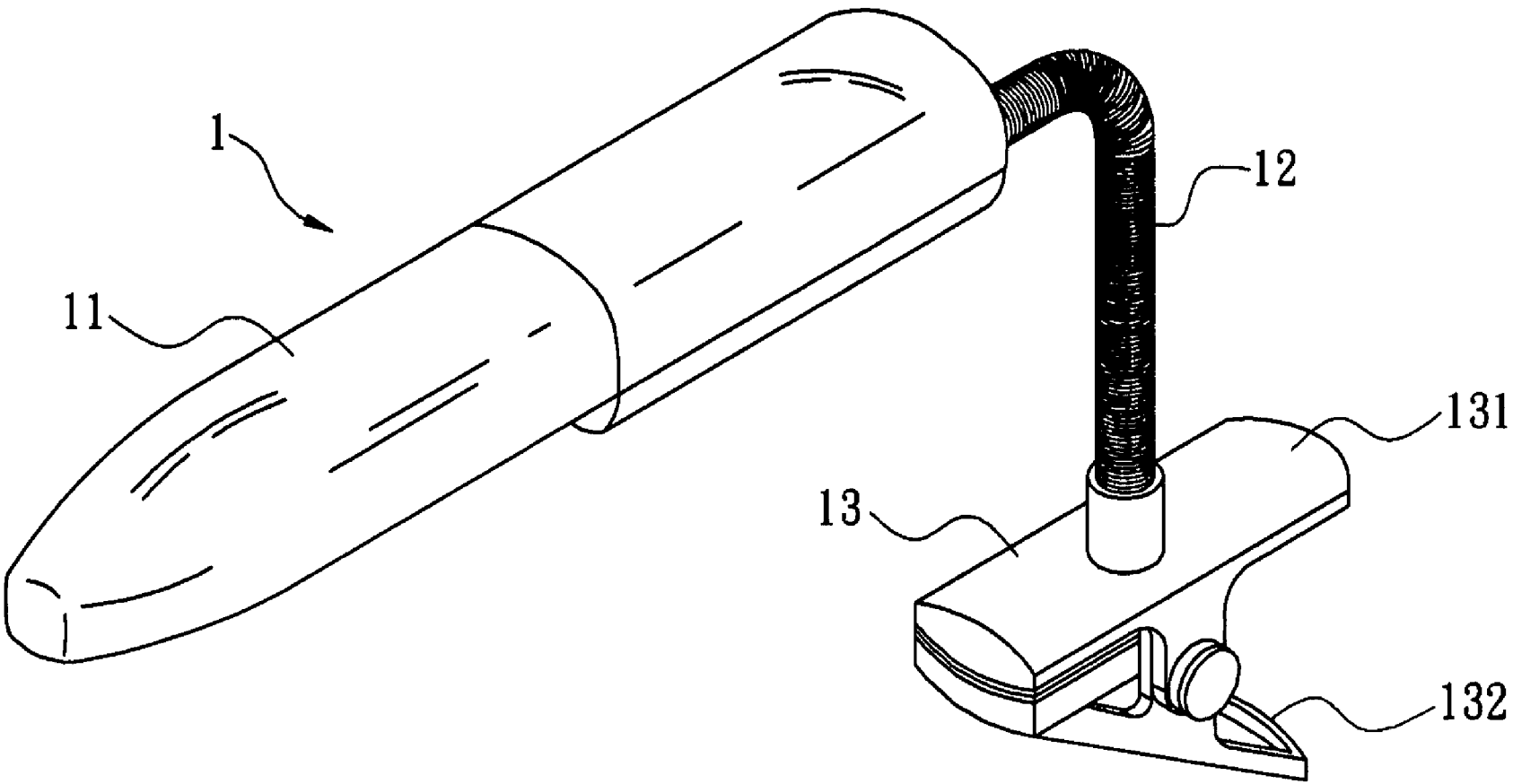
FIG. 8 PRIOR ART
FIG. 8 illustrates a conventional shelf lamp.

Of course, the shelf lamp of the present invention can provide light source pointing to different directions by changing the assembly position of the illuminating unit 3 onto the clamp mount 2. As shown in FIG. 5 to FIG. 7, the illuminating unit 3 can be harnessed on different connection portions of the clamp mount 2. When the user requires a light source pointing upward in the holding unit 5, the cover 4 on the connection portion 211 is first taken down, and the harness element 33 of the illuminating unit 3 is then inserted into the connection portion 211. The cover 4 is then moved to the connection portion 221 that was originally used for harnessing the illuminating unit 3. In this manner, a light source pointing upward is provided when the clamp mount 2 is fastened on the holding unit 5. Similarly, the illuminating unit 3 can easily and quickly switched to the connection portion 222 (as shown in FIG. 6), or the connection portion 212 (as shown in FIG. 7). Consequently, the shelf lamp of the present invention can provide light to the entire shelf without any dead corner. In addition, since the clamp mount 2 and the illuminating unit 3 are detachable, the package size thereof is relatively smaller than that of the conventional shelf lights. Therefore, the cost of transportation and storage can be reduced significantly.

Since, any person having ordinary skill in the art may readily find various equivalent alterations or modifications in light of the features as disclosed above, it is appreciated that the scope of the present invention is defined in the following claims. Therefore, all such equivalent alterations or modifications without departing from the subject matter as set forth in the following claims is considered within the spirit and scope of the present invention.

What is claimed is:

1. A shelf lamp, comprising:

a clamp mount, which comprises two clamp arms and an elastic element pivotally connecting the clamp arms, each of the clamp arms comprising a connection portion located at one or two ends of an outer surface of the clamp arm; and a detachable illuminating unit comprising a lamp shell and a lighting emitting element wherein the lamp shell has a harness element at one end thereof for harnessing onto one of the connection portion, wherein the lamp shell has a flat surface facing and aligning with the flat outer surface of one clamp arm.

2. The shelf lamp as recited in claim 1, wherein the connection portion is of a concave shape formed on the end of the clamp arm.

3. The shelf lamp as recited in claim 1, wherein the holding unit is one of a bookshelf, a desk, and a desk.

4. The shelf lamp as recited in claim 1, wherein clamp arm is hollow inside, thereby forming the connection portions.

5. A shelf lamp, comprising:

a clamp mount, which comprises two clamp arms and an elastic element pivotally connecting the clamp arms, each of the clamp arms comprising a connection portion located at one or two ends of an outer surface of the clamp arm; and a detachable illuminating unit comprising a lamp shell and a lighting emitting element wherein the lamp shell has a harness element at one end thereof for harnessing onto one of the connection portion, wherein both the connection portion and the harness element are in the semicircle column shape.

6. The shelf lamp as recited in claim 1, wherein the lamp is an elongate column shape which is straightly aligned with the connection portion.

* * * * *